US011631929B2

(12) United States Patent
Isambard et al.

(10) Patent No.: US 11,631,929 B2
(45) Date of Patent: Apr. 18, 2023

(54) FASTENING DEVICE AND ASSOCIATED METHOD

(71) Applicant: Nokia Shanghai Bell Co. Ltd., Pudong Jingiao (CN)

(72) Inventors: Loic Isambard, Trignac (FR); Julien Tessier, Trignac (FR)

(73) Assignee: Nokia Shanghai Bell Co. Ltd., Pudong Jinqiao (CN)

( * ) Notice: Subject to any disclaimer, the term of this patent is extended or adjusted under 35 U.S.C. 154(b) by 222 days.

(21) Appl. No.: 16/625,129

(22) PCT Filed: Jun. 21, 2018

(86) PCT No.: PCT/IB2018/054591

§ 371 (c)(1),
(2) Date: Dec. 20, 2019

(87) PCT Pub. No.: WO2018/235034

PCT Pub. Date: Dec. 27, 2018

(65) Prior Publication Data

US 2021/0336322 A1 Oct. 28, 2021

(30) Foreign Application Priority Data

Jun. 21, 2017 (EP) ..... 17305765

(51) Int. Cl.
*H01Q 1/12* (2006.01)

(52) U.S. Cl.
CPC ..... *H01Q 1/1228* (2013.01); *H01Q 1/125* (2013.01); *H01Q 1/1242* (2013.01)

(58) Field of Classification Search
CPC ..... H01Q 1/12; H01Q 1/1207; H01Q 1/1228; H01Q 1/1242; H01Q 1/125; H01Q 1/1264;

(Continued)

(56) References Cited

U.S. PATENT DOCUMENTS 6,956,526 B1 10/2005 Lundstedt, Jr. et al.
2007/0146229 A1 6/2007 Lin (Continued)

FOREIGN PATENT DOCUMENTS

CN 2736951 Y 10/2005
CN 1771625 A 5/2006

(Continued)

OTHER PUBLICATIONS

International Search Report for PCT/IB2018/054591 dated Oct. 12, 2018.

*Primary Examiner* — Robert Karacsony
(74) *Attorney, Agent, or Firm* — Lippes Mathias LLP

(57) ABSTRACT

A fastening device (10) for fastening an antenna (1) to a support (5) comprising: —a first element (10*a*) configured to be fixed on the support (5), —a second element (10*b*) configured for linking the first element (10*a*) to the antenna (1), —a first setting unit (16) for setting an angular orientation of the second element (10*b*) with respect to the first element (10*a*), wherein the first setting unit (16) comprises: —a first and a second pairs of holes (20*a*, 20*b*, 21*a*, 21*b*) made in one of the first or second elements (10*a*, 10*b*), the holes (20*a*, 20*b*, 21*a*, 21*b*) of a pair facing each other, —at least one through opening (18) having an arced oblong cross-section made in the other of the first or second element (10*a*, 10*b*), the at least one through opening (18) being configured to be placed between the two holes (20*a*, 20*b*) (21*a*, 21*b*) of a pair, —at least a first and a second axles (22), an axle (22) being configured to be placed through both the holes (20*a*, 20*b*) (21*a*, 21*b*) of a pair and a through opening (18), —first tightening means (24) configured for blocking a relative displacement between the first and the second elements (10*a*, 10*b*).

14 Claims, 8 Drawing Sheets

(58) Field of Classification Search
CPC .. H01Q 3/02; H01Q 3/04; H01Q 3/06; H01Q 3/08
See application file for complete search history.

(56) References Cited

U.S. PATENT DOCUMENTS

| | | | | |
|---|---|---|---|---|
| 2010/0127946 | A1 | 5/2010 | Tung | |
| 2014/0346294 | A1* | 11/2014 | Lewry | H01Q 1/125 248/201 |

FOREIGN PATENT DOCUMENTS

| | | | |
|---|---|---|---|
| CN | 201503908 | U | 6/2010 |
| CN | 201946736 | U | 8/2011 |
| CN | 105009359 | A | 10/2015 |
| CN | 205828638 | U | 12/2016 |
| CN | 205944383 | U | 2/2017 |
| DE | 202009010717 | U1 | 11/2009 |
| EP | 0880195 | A1 | 11/1998 |
| JP | 2008244510 | A | 10/2008 |
| JP | 2010-135719 | A | 6/2010 |
| JP | 2012138761 | A | 7/2012 |
| WO | WO 2004/109845 | A1 | 12/2004 |
| WO | WO 2009/008601 | A1 | 1/2009 |

* cited by examiner

-- Prior Art --

-- Prior Art --

-- Prior Art --

-- Prior Art --

-- Prior Art --

-- Prior Art --

FASTENING DEVICE AND ASSOCIATED METHOD

BACKGROUND OF THE INVENTION

The present invention refers to a fastening device for fastening an antenna to a support and in particular a parabolic microwave antenna to a pole.

Indeed, in order to optimize the signal transmission between a transmission antenna and a reception antenna, both the transmission antenna and the reception antenna have to be directed in a particular direction called alignment. Thus, the antennas have to be fastened to a support such as a pole and the fastening means has to enable both the fastening and the setting up in the right direction functions.

FIG. 1*a* to 1*c* show an antenna 1 and a first fastening device 3 according to the state of the art to fasten the antenna to a pole 5. This first fastening device 3 comprises two separate parts noted P1 and P2. The first part P1, forming a first collar, is first tightened to the pole 5 and the second part P2 is linked to the antenna and comprises a second collar positioned above the first part P1 so that the first part P1 prevents the second part P2 and the antenna 1 from falling down during the setting up of the antenna 1 in the right direction to adjust the azimuth direction of the antenna 1. When the antenna 1 is positioned in the right direction, the second part P2 is tightened to the pole 5 to block the movement of the second part P2. However, such solution implies the use of several parts P1, P2 that have to be fastened in a predetermined order which can be confusing for the installers. Moreover, the first part P1 is used only as a safety during the set up of the second part P2. Furthermore, the precision of the alignment depends on the diameter of the pole 5 as the center of the pole 5 corresponds to the center of rotation and as the antennas 1 can be fastened to poles 5 having different diameters, for example between 48 and 114 mm.

FIG. 2*a* to 2*c* show an antenna and a second fastening device 3' according to the state of the art enabling overcoming some drawbacks of the first fastening device 3 presented previously. This second fastening device 3' comprises a single part and the center of rotation for setting the alignment is independent of the center of the pole 5. However, with such embodiment, the space behind the antenna may be limited with some settings. Indeed, radio housing 7 are usually positioned at the back of the antenna 5 and these radio housings 7 are usually bulky so there may be a limitation in the setting so that the best alignment cannot be reached. Such collision between the radio housing 7 and the fastening device 3' is represented in FIG. 2*c* by the dotted circle. One solution to this problem would be to move the antenna 1 further off the pole 5 but such solution would lead to a higher wind surface area and a higher lever arm which would lead to more stress on the materials, to larger and therefore more expensive materials and to a degradation of the signal due to the movement and vibration of the antenna 1 (under the effect of the wind).

It is therefore a goal of the present invention to propose a fastening device of an antenna 1 enabling an easy and accurate alignment without increasing the cost of the device with respect to the solutions of the state of the art and without requiring to move the antenna further off to avoid collision between a radio housing 7 and the fastening device.

SUMMARY OF THE INVENTION

The present invention refers to a fastening device for fastening an antenna to a support such as a pole comprising:

- a first element configured to be fixed on the support,
- a second element configured for linking the first element to the antenna,
- a first setting unit for setting an angular orientation of the second element with respect to the first element, wherein the first setting unit comprises:

- a first and a second pairs of holes made in one of the first or second elements, the holes of a pair facing each other,
- at least one through opening having an arced oblong cross-section made in the other of the first or second element, the at least one through opening being configured to be placed between the two holes of a pair,
- at least a first and a second axles, an axle being configured to be placed through both the holes of a pair and a through opening,
- first tightening means configured for blocking a relative displacement between the first and the second elements.

According to another aspect of the present invention, the first setting unit also comprises:

- a first set comprising a first pin attached to one of the first or the second elements and a complementary hole made in the other of the first or the second elements, the first pin being linked to a first screw such that the first pin is displaced along the first screw when the first screw is turned, the displacement of the first pin with respect to the first screw producing a displacement of the at least one through opening of the other element with respect to the axles.

According to another aspect of the present invention, the first tightening means comprise a first and a second bolts formed by the first and the second axles and a first and a second nuts configured to be fastened to the respective first and second bolts.

According to another aspect of the present invention, the first setting unit is configured for setting an azimuth angle.

According to another aspect of the present invention, the fastening device also comprises:

- a third element configured for linking the second element to the antenna,
- a second setting unit for setting an angular orientation of the third element with respect to the second element.

According to another aspect of the present invention, the second setting unit is configured for setting an elevation angle.

According to another aspect of the present invention, the second setting unit is similar to the first setting unit with openings having an arced oblong cross-section and complementary axles and a second set comprising a second pin and a second screw.

According to another aspect of the present invention, the second setting unit comprises:

- a central hole made in one of the second or third elements,
- a central pin made in the other of the second or third elements which is complementary to the central hole, the central pin being configured to be placed in the central hole so that the relative move of the third element with respect to the second element is a rotation around the axis of the central pin and the central hole,
- second tightening means configured for blocking a relative move between the second and the third elements.

According to another aspect of the present invention, the second tightening means comprise:

- at least one through opening having an arced oblong cross-section made in the one of the second or third elements, the arc being centered on the central hole, at least one through opening made in the other of the second or third element facing the through hole, at least one bolt configured to be placed in both the through opening and the through hole, at least one nut configured to be fastened respectively to the at least one bolt.

According to another aspect of the present invention, the second setting unit also comprises:

a second set comprising a second pin attached to one of the second or the third element and a complementary hole made in the other of the second or the third element, the second pin being linked to a second screw such that the second pin is displaced along the second screw when the second screw is turned, the displacement of the second pin with respect to the second screw producing a rotation of the third element with respect to the second element.

According to another aspect of the present invention, the first element is a collar configured to be fastened to a pole or a pylon.

According to another aspect of the present invention, the antenna is a parabolic microwave antenna.

The present invention also refers to a method for fastening an antenna to a support using a fastening device as described previously wherein the method comprises the following steps:

fastening the first element to the support, setting the position of the second element with respect to the first element with the first screw of the first setting unit, when the position of the second element is set, tightening the first tightening means for blocking the position of the second element.

The present invention also refers to a method for fastening an antenna to a support using a fastening device as described previously wherein the method comprises the following steps:

fastening the antenna to the third element, fastening the first element to the support, setting the position of the second element with respect to the first element with the first screw of the first setting unit, setting the position of the third element with respect to the second element using the second screw of the second setting unit, when the position of the second and the third elements are set, tightening the first tightening means for blocking the position of the second element, tightening the second tightening means for blocking the position of the third element.

DETAILED DESCRIPTION OF THE INVENTION

The present invention refers to a device for fastening an antenna, notably a microwave parabolic antenna, to a support, for example a pole.

Figure 1A:
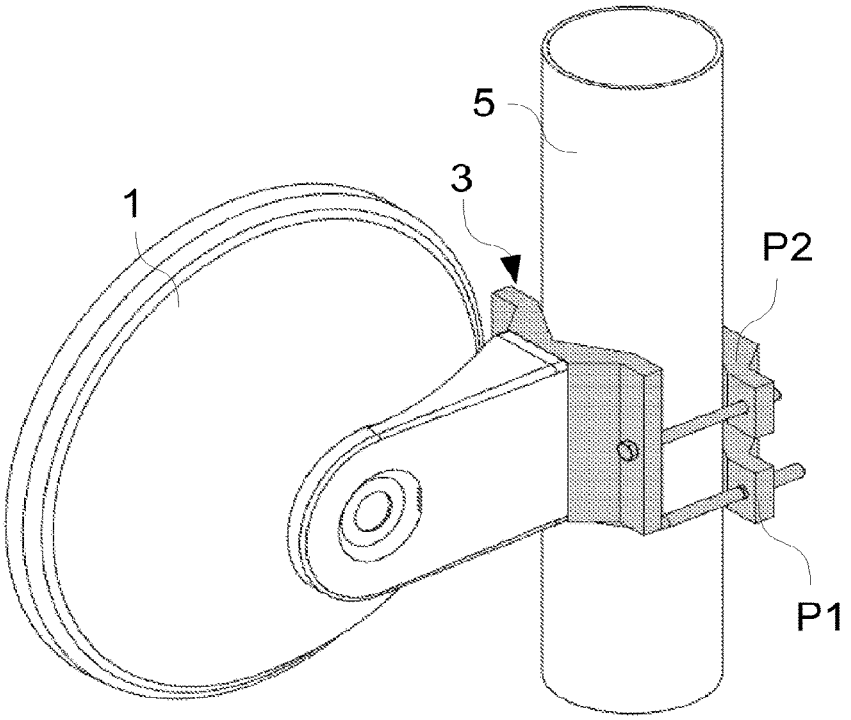
FIGS. 1*a*, 1*b* and 1*c* are different views of an antenna and a fastening device according to a first embodiment of the state of the art.
Figure 1B:
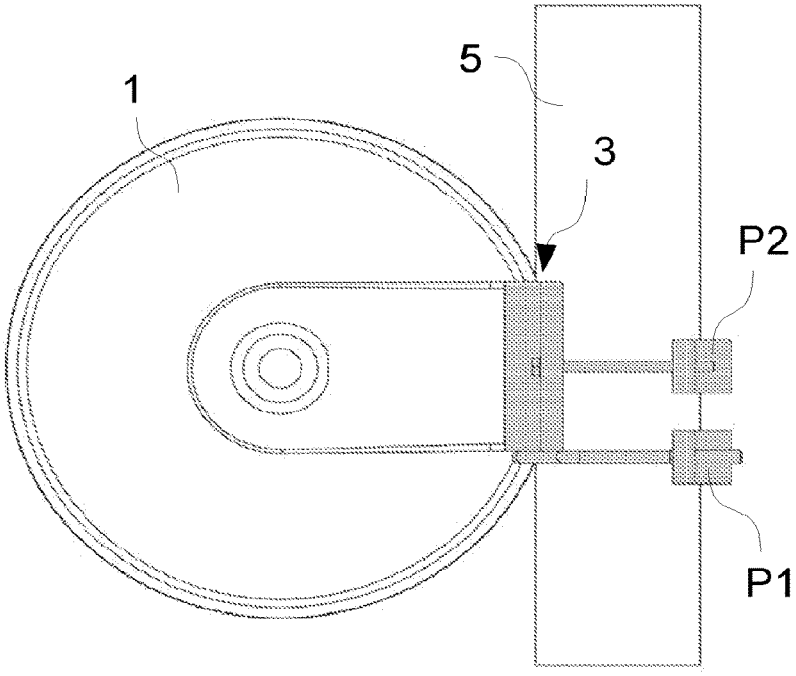
Figure 1C:
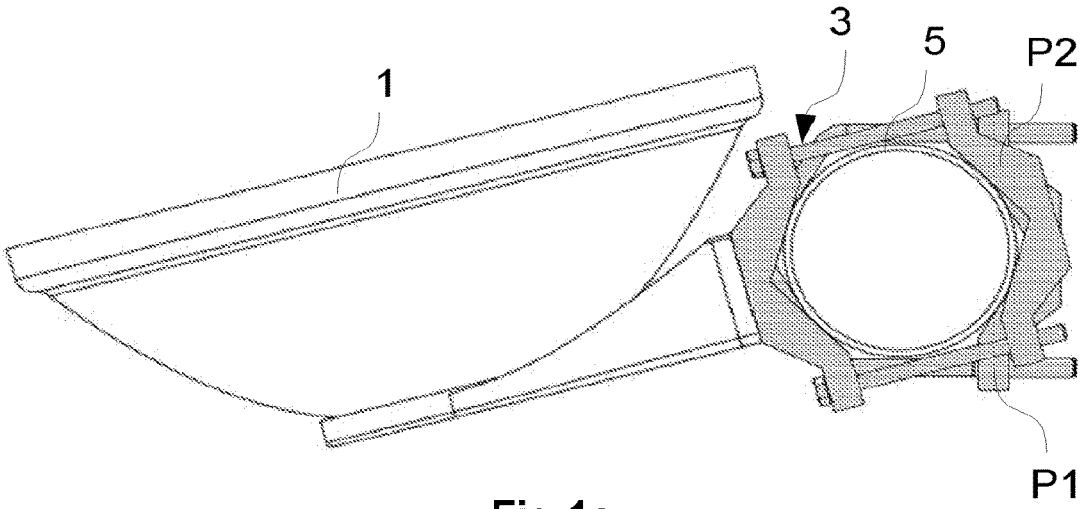
Figure 2A:
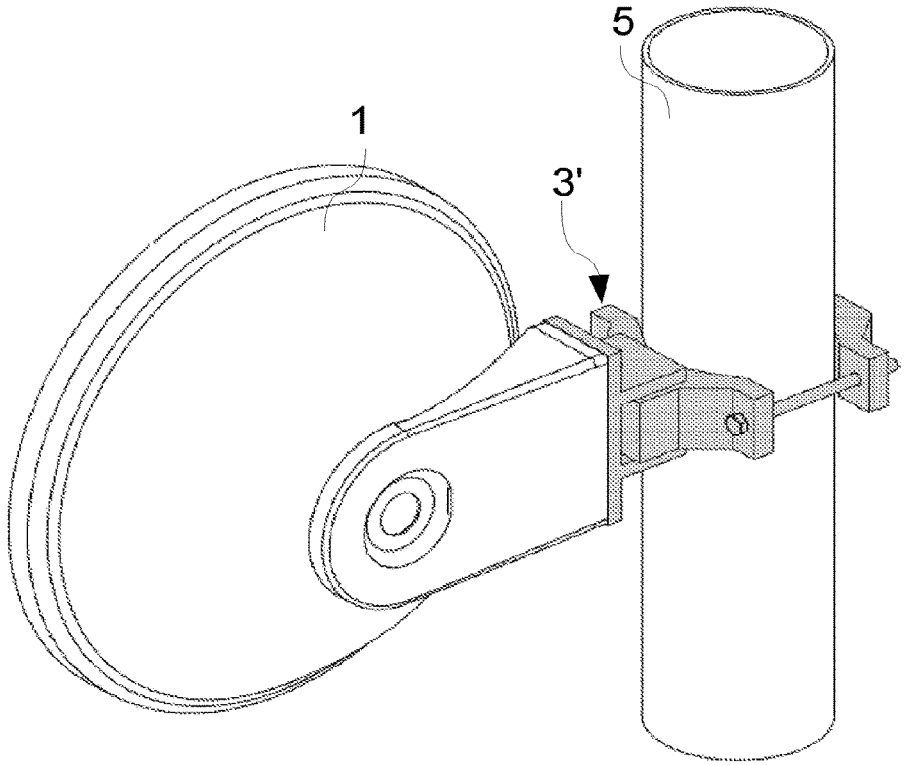
FIGS. 2*a*, 2*b* and 2*c* are different views of an antenna and a fastening device according to a second embodiment of the state of the art.
Figure 2B:
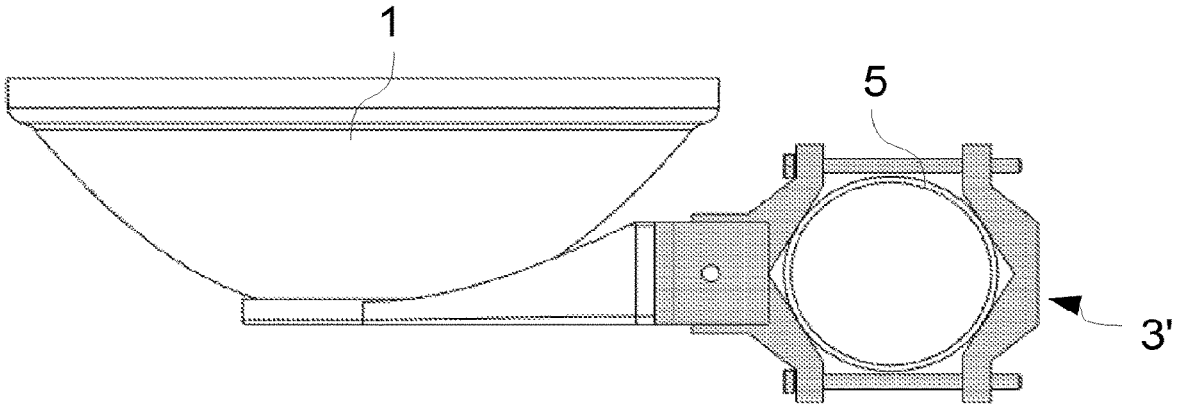
Figure 2C:
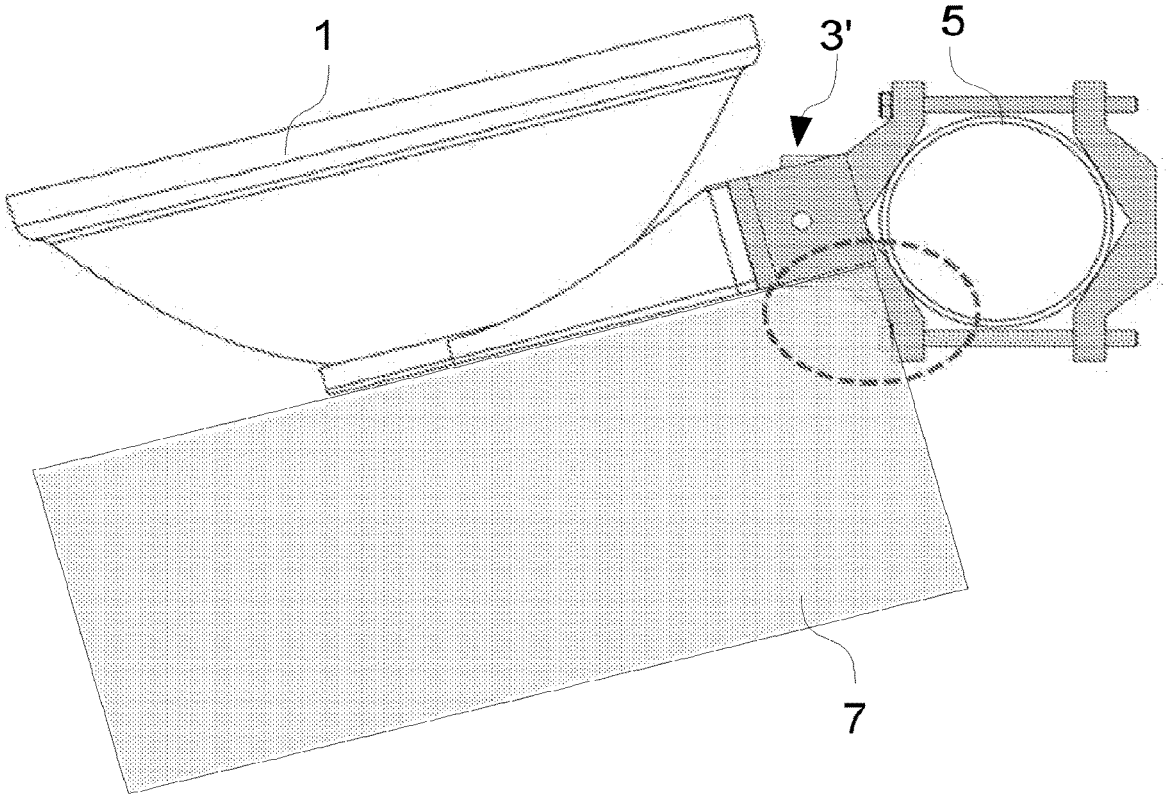
Figure 3:
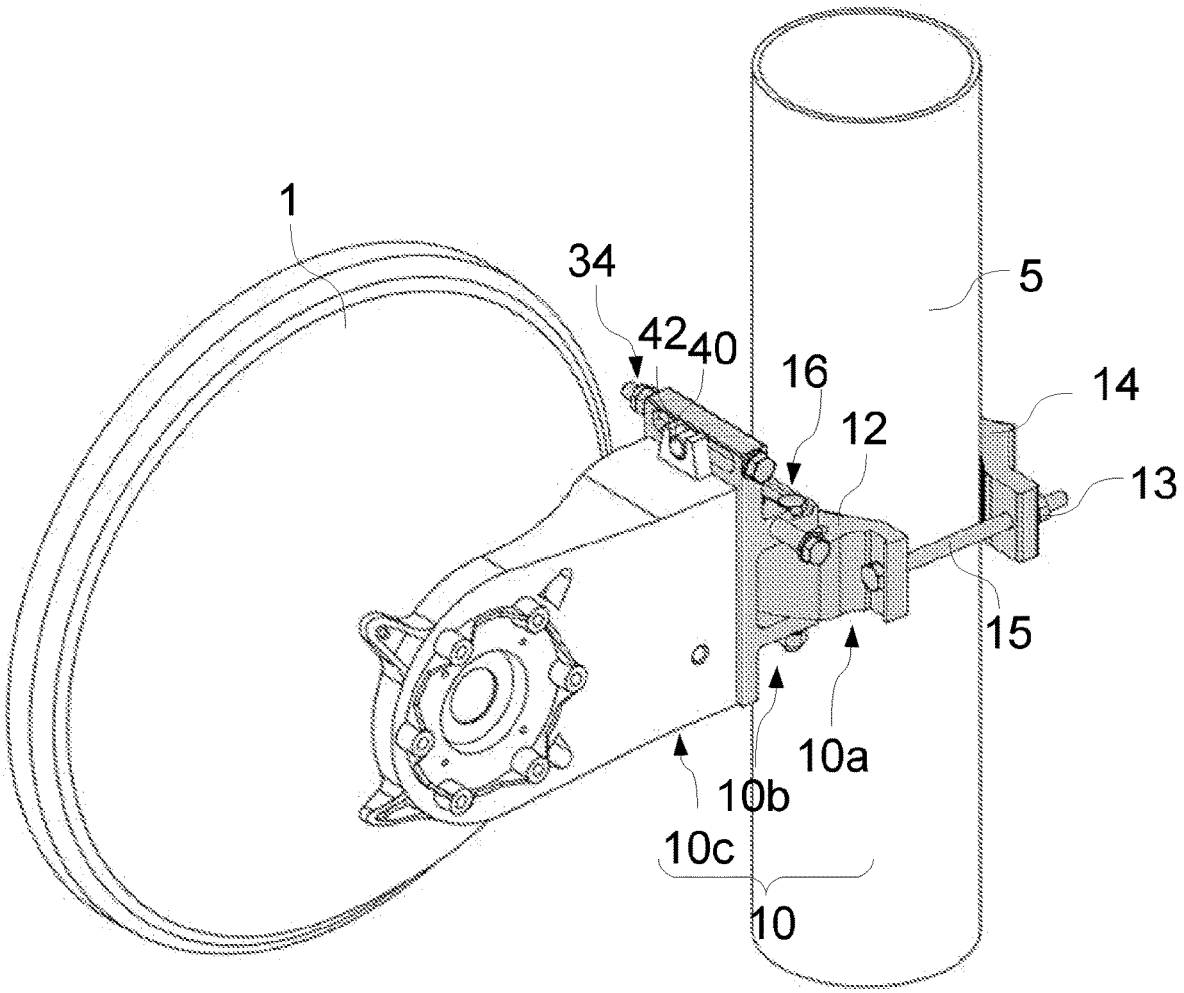
FIG. 3 is a view in perspective of an antenna and a fastening device in accordance with an embodiment of the present invention.
Figure 4:
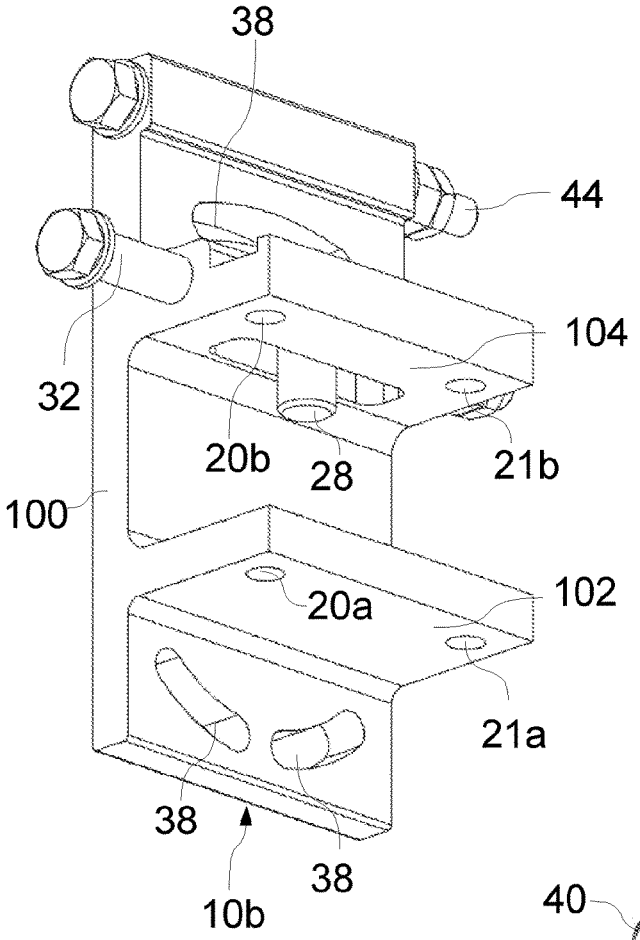
FIG. 4 is a perspective view of a second element of a fastening device in accordance with an embodiment of the present invention.
Figure 5:
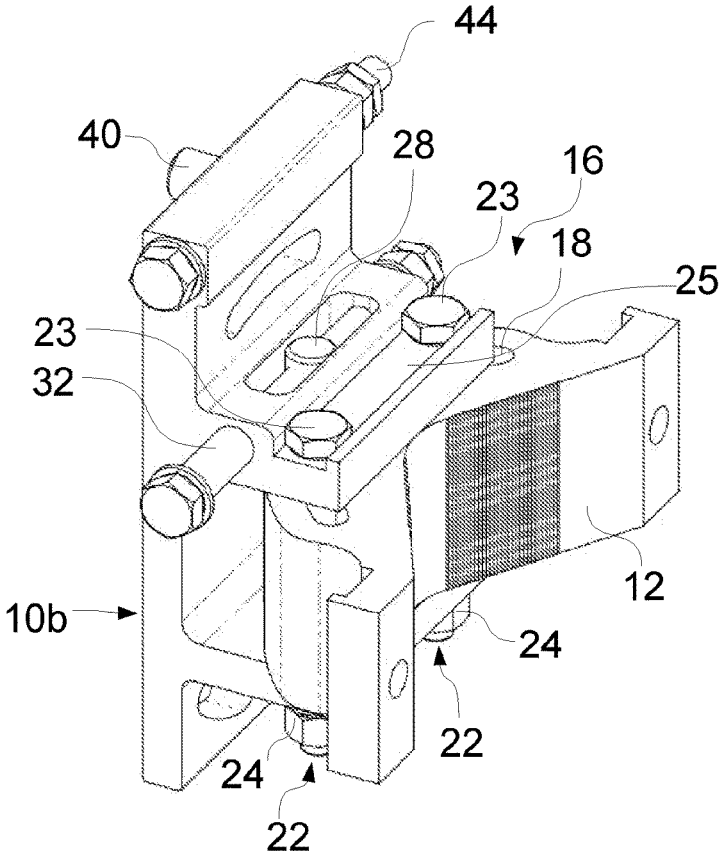
FIG. 5 is a perspective view of a portion of a fastening device in accordance with an embodiment of the present invention.

FIG. 3 represents a diagram of the antenna 1 and the fastening device 10 according to the present invention. The fastening device 10 comprises a first element 10*a* configured to be fastened to the support, a pole 5 in the present example. The first element 10*a* comprises for example a first part 12 and a second part 14 having arced shape and configured to be placed around the pole 5 and linked to each other by screws or by bolts 15 and nuts 13. Other configurations for fastening the first element 10*a* to the pole 5 may also be used. The first 12 and the second 14 parts may comprise scratches or striations on the inner part in order to prevent the first element 10*a* from rotating around the pole 5 when tightened. The fastening device 10 also comprises a second element 10*b* configured for linking the first element 10*a* and the antenna 1. As represented in FIG. 4, the second element 10*b* comprises for example a main plate 100 with a first 102 and a second 104 sidewalls forming a U-shape with the central part of the main plate 100 and protruding perpendicular from the main plate 100. The U-shape is configured for receiving a portion of the first element 10*a* as represented in FIG. 5.

Figure 6:
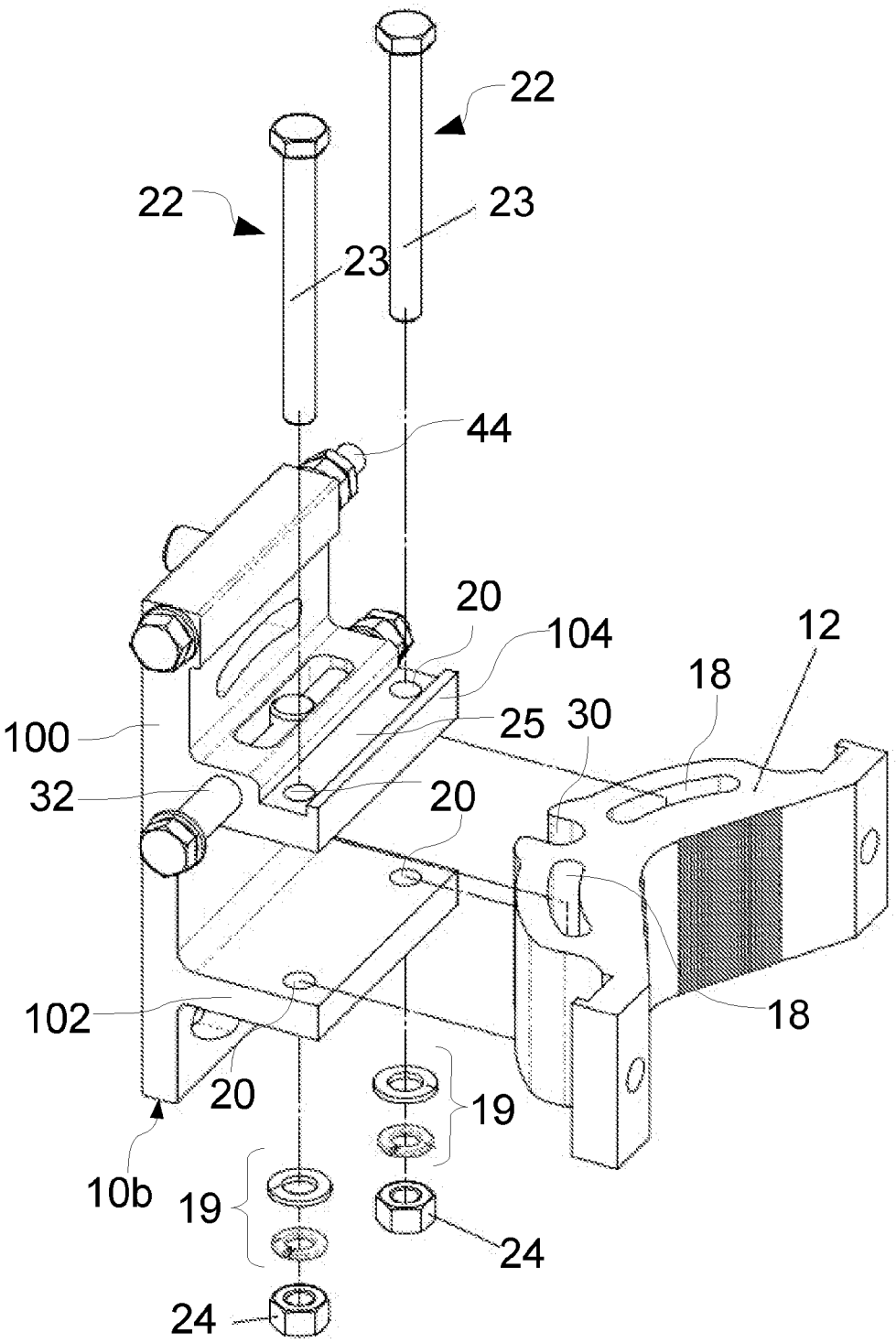
FIG. 6 is an exploded view of the portion of the fastening device of FIG. 5.

The fastening device 10 also comprises a first setting unit 16 configured for setting an angular orientation between the first element 10*a* and the second element 10*b*. This angular orientation corresponds for example to an azimuth orientation of the antenna 1 (the pole 5 being considered vertical). The first setting unit 16 comprises at least one through opening 18, two in the present case, made in the first element 10*a*. The direction of the at least trough opening 18 corresponds to the axis of the pole 5 when the first element 10*a* is fastened on the pole 5. The through openings 18 have an oblong arced section as represented in FIG. 6. The diameter of the arc shape is determined according to the required accuracy for the azimuth setting of the antenna 1. The first setting unit 16 also comprises a first pair of holes 20*a*, 20*b* and a second pair of holes 21*a*, 21*b* made in the second element 10*b*. The first hole 20*a*, 21*a* of a pair is made in the first sidewall 102 and the second hole 20*b*, 21*b* of a pair is made in the second sidewall 104. The holes 20*a*, 20*b* and 21*a*, 21*b* of a pair face each other. The first 10*a* and the second 10*b* elements are configured such that the at least one through opening 18 of the first element 10*a* can be placed between the first and the second pairs of holes 20*a*, 20*b*, 21*a*, 21*b* so that an axle 22 can be positioned through both the holes 20*a*, 20*b* and 21*a*, 21*b* of a pair and a through opening 18 as represented in FIG. 5. The axles 22 are for example made by bolts 23 and associated first tightening means made by nuts 24 are used to fasten the axles and set the position of the axles 22 with respect to the through opening 18 and therefore the position between the first element 10*a* and the second element 10*b*. Additional spacers 19 may be used for tightening the axles as shown in FIG. 6. Furthermore, the second sidewall 104 may comprise a groove 25 configured for receiving the bolts heads and for blocking the rotation of the bolts in order to ease the tightening of the axles 22.

Alternatively, the at least one through opening 18 can be made in the second element 10*b* and the pairs of holes 20*a*, 20*b* and 21*a*, 21*b* can be made in the first element 10*a* leading to the same result as the above described embodiment.

The first setting unit 16 enables therefore a displacement of the second element 10*b* with respect to the first element 10*a* which is independent of the diameter of the pole 5 and which does not require complicated equipment and does not limit the displacement of the antenna 1 with respect to the pole 5 even with a bulky radio housing 7 located at the back of the antenna 1.

The first setting unit 16 may also be configured for adjusting precisely the relative position between the first element 10*a* and the second element 10*b* and may therefore comprise a first set comprising a first pin 28 (represented in FIG. 4) attached to one of the first element 10*a* or the second element 10*b* (in the main plate 100 of the second element 10*b* in the present case) and a complementary hole 30, for example a complementary slot, made in the other of the first 10*a* or the second 10*b* element (in the first element 10*a* in the present case), the first pin 28 being linked to a first screw 32 such that the first pin 28 is displaced along the first screw 32 when the first screw 32 is turned, the displacement of the first pin 28 with respect to the first screw 32 producing a displacement of the at least one through opening 18 of the first element 10*a* with respect to the axles 22 of the second element 10*b*. The first screw 32 is positioned perpendicular to the axles 22 and within the second sidewall 104 (alternatively in the first sidewall 102). Thus, the azimut angle of the antenna can be adjusted by rotating the first screw 32 (when the nuts 24 associated with the axles 22 are not tightened). When the azimut angle is set in the right position, the nuts 24 can be tightened to set the position of the second element 10*b* with respect to the first element 10*a*.

The fastening device 10 may also comprise a third element 10*c* configured for linking the second element 10*b* to the antenna 1. Alternatively, the third element may be formed by the antenna 1.

Figure 7:
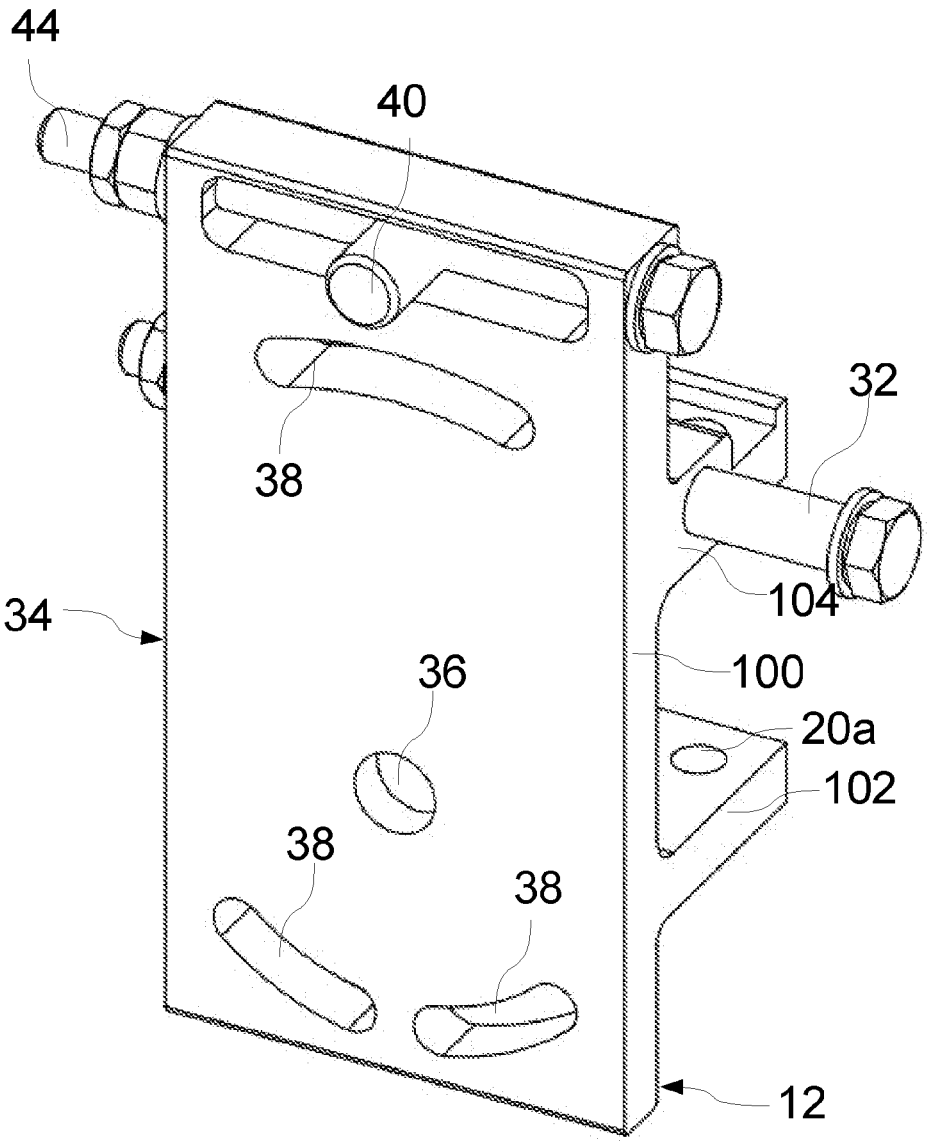
FIG. 7 is another perspective view of the second element of the fastening device of FIG. 4.

The fastening device 10 also comprises a second setting unit 34 shown in FIG. 7 for setting an angular orientation of the third element 10*c* with respect to the second element 10*b*, for example an elevation angle of the antenna 1.

The second setting unit 34 comprises for example a central hole 36 made in one of the second 10*b* or third 10*c* element (the second element 10*b* in the present case) and a central pin (not represented) made in the other of the second 10*b* or third 10*c* elements (in the third element 10*c* in the present case) which is complementary to the central hole 36. The central pin is configured to be placed in the central hole 36 so that the relative move of the third element 10*c* with respect to the second element 10*b* is a rotation around the axis formed by the central pin and the central hole 36.

The second setting unit 34 also comprises second tightening means configured for blocking a relative move between the second element 10*b* and the third element 10*c*. The second tightening means comprise at least one through hole made in the second element 10*b* and in the third element 10*c*, the through holes in the second 10*b* and in the third 10*c* elements being configured to face each other when the central pin is placed in the central hole 36. In the present case, the tightening means comprise three through holes 38 having an arced shape made in the second element and three holes (not represented) made in the third element 10*c*. The arc shape of the through holes 38 is centered on the central hole 36. The tightening means also comprise three bolts destined to be placed in the respective through holes 38 of the second 10*b* and the third 10*c* elements and three nuts or three threads destined to be screwed on the respective bolts. Thus, the bolts and nuts enables to set the elevation angle by blocking the movement of the third element 10*c* with respect to the second element 10*b*.

The second setting unit 34 may also be configured for adjusting precisely the relative position between the third element 10*c* and the second element 10*b* and may therefore comprise a second set comprising a second pin 40 attached to one of the second 10*b* or the third 10*c* element, the second element 10*b* in the present case as represented in FIG. 7. The second set also comprises a complementary hole made in the other of the second 10*b* or the third 10*c* element, a slot 42 made in the third element in the present case as represented in FIG. 3. The second pin 40 is linked to a second screw 44 such that the second pin 40 is displaced along the second screw 44 when the second screw 44 is turned, the displacement of the second pin 44 with respect to the second screw 44 producing a rotation of the third element 10*c* with respect to the second element 10*b* enabling the adjustment of the elevation angle of the antenna. When the elevation angle is set in the right position, the nuts associated with the bolts located in the through holes 38 can be tightened.

In the present embodiment, the antenna 1 and the radio housing are screwed to the third element but the third element may also be a part of the antenna and or of the radio housing.

Alternatively, the second setting unit 34 may be similar to the first setting unit 16 (i.e. with openings having an arced oblong cross-section and complementary axles passing through the openings instead of a central hole and a central pin), the second setting unit also comprising a second pin and a second screw.

The different elements and parts of the fastening device 10 are for example made of aluminium.

Figure 8:
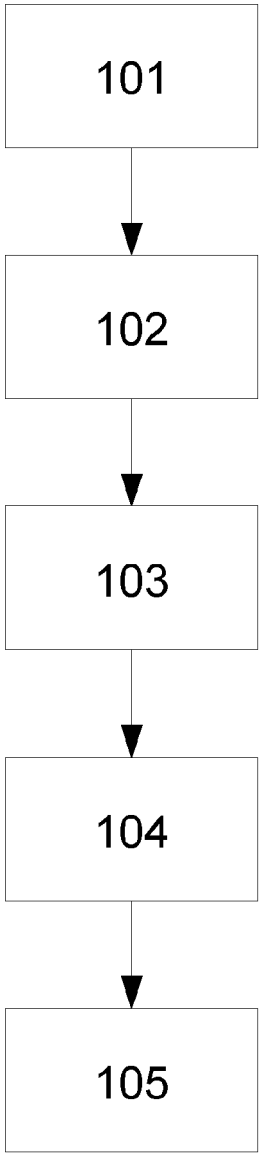
FIG. 8 is a flowchart of the different steps for fastening an antenna to a pole using the fastening device of FIGS. 3 to 7.

The different steps of the method for fastening an antenna 1 to a pole 5 using the fastening device 10 described previously will now be described based on FIG. 8. It is supposed that the antenna 1 is already fastened to the fastening device 10, for example by screws linking the antenna 1 to the third element 10*c* of the fastening device 10.

The first step 101 refers to the positioning and the tightening of the fastening device 10 on the pole 5. Such fastening is achieved with the bolts 15 and nuts 13. The first element 10*a* is then fastened to the pole 5.

The second step 102 refers to the setting of the azimut angle using the first setting unit 16 and in particular the first screw 28 of the first set. The first screw is rotated until the right setting of the azimut angle is reached.

The third step 103 refers to the setting of the elevation angle using the second setting unit 34 and in particular the second screw 44 of the second set. The second screw is rotated until the right setting of the elevation angle is reached.

The fourth step 104 refers to the tightening of the first setting unit 16 using the bolts 23 and nuts 22 in order to block the relative movement between the first element 10*a* and the second element 10*b*.

The fifth step 105 refers to the tightening of second setting unit 34 to set the elevation angle using the bolts and nuts or screws located in the through holes 38 in order to block the relative movement between the second element 10*b* and the third element 10*c*.

The order of the third step 103 and the fourth step 104 may also be reversed.

It has also to be noted that the fastening device may comprise only a first element, a second element and a first setting unit with the first setting unit enabling setting the azimut or the elevation angle. The method for fastening the antenna comprises then the steps 101, 102 and 104.

Thus, the use of a fastening device comprising a setting unit 16 with arced through holes 18 in a first element 10*a* and axles 22 passing through these through holes 18 and linked to a second element 10*b* enables to combine in a single simple device the fastening to a support like a pole 5 and the setting of the azimut and the elevation angles of the antenna 1 in an easy way and independently of the features of the support such as the diameter of the pole

The invention claimed is:

1. A fastening device for fastening an antenna to a support comprising:

a first element configured to be fixed on the support, a second element configured for linking the first element to the antenna, and a first setting unit for setting an angular orientation of the second element with respect to the first element, wherein the first setting unit comprises:

a first and a second pairs of holes made in one of the first or second elements, the holes of a pair facing each other, at least one through opening made in the other of the first or second element, the at least one through opening being configured to be placed between the two holes of a pair, and the at least one through opening having an arced oblong cross section, at least a first and a second axles, said first axle being configured to be placed through both the holes of the first pair of holes, said second axle being configured to be placed through both the holes of the second pair of holes, and each of the first and second axles extending through a respective one of the at least one through opening, first tightening means configured for blocking a relative displacement between the first and the second elements.

2. The fastening device in accordance with claim 1 wherein the first tightening means comprise a first and a second bolts formed by the first and the second axles and a first and a second nuts configured to be fastened to the respective first and second bolts.

3. The fastening device in accordance with claim 1 wherein the first setting unit is configured for setting an azimuth angle.

4. The fastening device in accordance with claim 1 comprising:

a third element configured for linking the second element to the antenna, a second setting unit for setting an angular orientation of the third element with respect to the second element.

5. The fastening device in accordance with claim 4 wherein the second setting unit is configured for setting an elevation angle.

6. The fastening device in accordance with claim 3 wherein the second setting unit comprises:

at least one second through opening having an arced oblong cross section, at least a third and a fourth axles, at least one of said third and fourth axles extending through the at least one second through opening, and a second set comprising a second pin and a second screw, wherein the second pin is attached to one of the second or the third elements and a complementary hole made in the other of the second or the third elements, the second pin being linked to the second screw such that the second pin is displaced along the second screw when the second screw is turned, the displacement of the second pin with respect to the second screw producing a displacement of the at least one second through opening of the other element with respect to at least one of the third and fourth axles.

7. The fastening device in accordance with claim 1 wherein the first element is a collar configured to be fastened to a pole or a pylon.

8. The fastening device in accordance with claim 1 wherein the antenna is a parabolic microwave antenna.

9. A method for fastening an antenna to a support using a fastening device in accordance with claim 1 wherein the method comprises:

fastening the first element to the support, setting the position of the second element with respect to the first element with the first screw of the first setting unit, when the position of the second element is set, tightening the first tightening means for blocking the position of the second element.

10. A method for fastening an antenna to a support using a fastening device in accordance with claim 6 wherein the method comprises:

fastening the first element to the support, setting the position of the second element with respect to the first element with the first screw of the first setting unit, and when the position of the second element is set, tightening the first tightening means for blocking the position of the second element:

setting the position of the third element with respect to the second element using the second screw of the second setting unit, and when the position of the second element and the third element are set, tightening the second tightening means for blocking the position of the third element in addition to the tightening of the first tightening means for blocking the position of the second element.

11. A fastening device for fastening an antenna to a support comprising:

a first element configured to be fixed on the support;

a second element configured for linking the first element to the antenna;

a first setting unit for setting an angular orientation of the second element with respect to the first element, the first setting unit including:

a first and a second pairs of holes made in one of the first or second elements, the holes of a pair facing each other;

at least one through opening made in the other of the first or second element, the at least one through opening being configured to be placed between the two holes of a pair, and the at least one through opening having an arced oblong cross section;

at least a first and a second axles, an axle being configured to be placed through both the holes of a pair and a through opening; and first tightening means configured for blocking a relative displacement between the first and the second elements; and a first set comprising a first pin attached to one of the first or the second elements and a complementary opening made in the other of the first or the second elements, the first pin being linked to a first screw such that the first pin is displaced along the first screw when the first screw is turned, the displacement of the first pin with respect to the first screw producing a displacement of the at least one through opening of the other element with respect to the axles.

12. A fastening for fastening an antenna to a support comprising:

a first element configured to be fixed on the support;

a second element configured for linking the first element to the antenna;

a first setting unit for setting an angular orientation of the second element with respect to the first element, the first setting unit including:

a first and a second pairs of holes made in one of the first or second elements, the holes of a pair facing each other;

at least one through opening made in the other of the first or second element, the at least one through opening being configured to be placed between the two holes of a pair, and the at least one through opening having an arced oblong cross section;

at least a first and a second axles, an axle being configured to be placed through both the holes of a pair and a through opening; and first tightening means configured for blocking a relative displacement between the first and the second elements;

a third element configured for linking the second element to the antenna;

a second setting unit for setting an angular orientation of the third element with respect to the second element;

a central hole made in one of the second or third elements;

a central pin made in the other of the second or third elements which is complementary to the central hole, the central pin being configured to be placed in the central hole so that the relative move of the third element with respect to the second element is a rotation around the axis of the central pin and the central hole; and second tightening means configured for blocking a relative move between the second and the third elements.

13. The fastening device in accordance with claim 12 wherein the second tightening means comprise:

at least one through opening having an arced oblong cross-section made in the one of the second or third elements, the arc being centered on the central hole, at least one through opening made in the other of the second or third element facing the through hole, at least one bolt configured to be placed in both the through opening and the through hole, at least one nut configured to be fastened respectively to the at least one bolt.

14. The fastening device in accordance with claim 12 wherein the second setting unit also comprises:

a second set comprising a second pin attached to one of the second or the third element and a complementary hole made in the other of the second or the third element, the second pin being linked to a second screw such that the second pin is displaced along the second screw when the second screw is turned, the displacement of the second pin with respect to the second screw producing a rotation of the third element with respect to the second element.

* * * * *